US011107616B2

(12) United States Patent
Choi et al.

(10) Patent No.: US 11,107,616 B2
(45) Date of Patent: Aug. 31, 2021

(54) COIL COMPONENT

(71) Applicant: SAMSUNG ELECTRO-MECHANICS CO., LTD., Suwon-si (KR)

(72) Inventors: Young Do Choi, Suwon-si (KR); Yu Jong Kim, Suwon-si (KR); Sung Min Moon, Suwon-si (KR); Tae Ryung Hu, Suwon-si (KR); Sang Seob Kim, Suwon-si (KR); Dong Min Kim, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 248 days.

(21) Appl. No.: 16/218,204

(22) Filed: Dec. 12, 2018

(65) Prior Publication Data

US 2019/0304654 A1 Oct. 3, 2019

(30) Foreign Application Priority Data

Apr. 2, 2018 (KR) ..... 10-2018-0037993

(51) Int. Cl.
*H01F 27/32* (2006.01)
*H01F 17/00* (2006.01)
(Continued)

(52) U.S. Cl.
CPC ..... *H01F 17/0013* (2013.01); *H01F 27/255* (2013.01); *H01F 27/2804* (2013.01);
(Continued)

(58) Field of Classification Search
CPC ..... H01F 17/0013; H01F 17/04; H01F 2017/048; H01F 27/255; H01F 27/2804; H01F 27/323; H01F 27/324; H01F 27/292; H01F 2027/2809; H01F 41/12; H01F 41/041
See application file for complete search history.

(56) References Cited

U.S. PATENT DOCUMENTS 9,496,084 B2 11/2016 Han et al.
10,559,417 B2 2/2020 Ohkubo et al.
(Continued)

FOREIGN PATENT DOCUMENTS

CN 104900374 A 9/2015
CN 106205956 A 12/2016
(Continued)

OTHER PUBLICATIONS

Office Action issued in corresponding Korean Application No. 10-2018-0037993, dated Apr. 19, 2019.
(Continued)

*Primary Examiner* — Mang Tin Bik Lian
(74) *Attorney, Agent, or Firm* — Morgan, Lewis & Bockius LLP

(57) ABSTRACT

A coil component includes a body in which a coil part is embedded. The coil part includes a support member, pattern walls formed on the support member, and coil patterns extending between the pattern walls on the support member, and the pattern walls include support portions having a width greater than an average width of the pattern walls.

12 Claims, 5 Drawing Sheets

(51) Int. Cl.

| | |
|---|---|
| ***H01F 27/255*** | (2006.01) |
| ***H01F 27/28*** | (2006.01) |
| ***H01F 41/12*** | (2006.01) |
| ***H01F 41/04*** | (2006.01) |
| *H01F 17/04* | (2006.01) |

(52) U.S. Cl.
CPC ..... *H01F 27/323* (2013.01); *H01F 27/324* (2013.01); *H01F 41/041* (2013.01); *H01F 41/12* (2013.01); *H01F 2017/048* (2013.01); *H01F 2027/2809* (2013.01)

(56) References Cited

U.S. PATENT DOCUMENTS

2013/0049917 A1* 2/2013 Kim ..... H01F 41/041 336/200
2013/0222101 A1* 8/2013 Ito ..... H01F 5/003 336/83
2015/0035634 A1* 2/2015 Nakamura ..... H01F 41/046 336/170
2015/0102889 A1* 4/2015 Choi ..... H01F 17/0013 336/200
2015/0255206 A1* 9/2015 Han ..... H01F 17/0013 336/192
2015/0255208 A1* 9/2015 Kim ..... H01F 17/0006 336/200
2015/0270053 A1* 9/2015 Cha ..... C25D 5/02 336/192
2016/0086720 A1* 3/2016 Jeong ..... H01F 17/0013 336/200
2016/0104564 A1* 4/2016 Jeong ..... H01F 17/06 336/200
2016/0351316 A1* 12/2016 Ohkubo ..... H01F 27/325
2017/0178790 A1 6/2017 Kim et al.

FOREIGN PATENT DOCUMENTS

JP 2016-225464 A 12/2016
JP 2017-017139 A 1/2017
JP 2017-017140 A 1/2017
KR 10-2016-0140391 A 12/2016
KR 10-2017-0073159 A 6/2017

OTHER PUBLICATIONS

Office Action issued in corresponding Chinese Patent Application No. 201910227423.X dated Dec. 28, 2020, with English translation.

* cited by examiner

COIL COMPONENT

CROSS-REFERENCE TO RELATED APPLICATION(S)

This application claims benefit of priority to Korean Patent Application No. 10-2018-0037993 filed on Apr. 2, 2018 in the Korean Intellectual Property Office, the disclosure of which is incorporated herein by reference in its entirety.

TECHNICAL FIELD

The present disclosure relates to a coil component.

BACKGROUND

In accordance with the miniaturization and thinning of electronic devices such as a digital television (TV), a mobile phone, a notebook computer, and the like, the miniaturization and thinning of coil components used in these electronic devices have been demanded. In order to satisfy such demand, various types of coil components have been developed.

One of the main issues regarding the miniaturization and thinning of coil components is to maintain the number of winding of coils and a cross-sectional area of a coil pattern, and to implement characteristics equal to characteristics of an existing coil component in spite of such miniaturization and the thinning of the coil component. In order to satisfy such a demand, a pattern wall technology capable of increasing an aspect ratio of the coil pattern while significantly reducing electrical over stress (EOS) generated when an interval between the coil patterns becomes narrower has been researched.

SUMMARY

An aspect of the present disclosure may provide a coil component capable of securing stable characteristics by using pattern walls including support portions.

According to an aspect of the present disclosure, a coil component may include a body in which a coil part is embedded. The coil part may include a support member, pattern walls formed on the support member, and coil patterns extending between the pattern walls on the support member, and the pattern walls may include support portions having a width greater than an average width of the pattern walls.

BRIEF DESCRIPTION OF DRAWINGS

The above and other aspects, features and other advantages of the present disclosure will be more clearly understood from the following detailed description taken in conjunction with the accompanying drawings, in which.

DETAILED DESCRIPTION

Hereinafter, exemplary embodiments of the present disclosure will now be described in detail with reference to the accompanying drawings.

Figure 1:
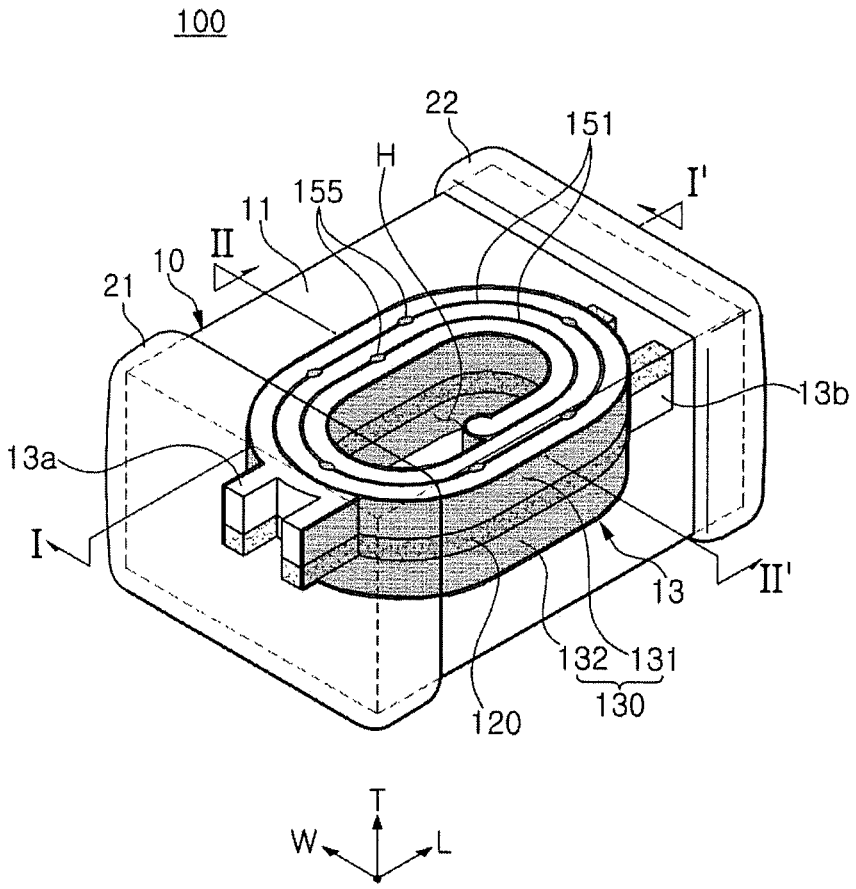
FIG. 1 is a schematic perspective view illustrating a coil component according to an exemplary embodiment in the present disclosure.
Figure 2:
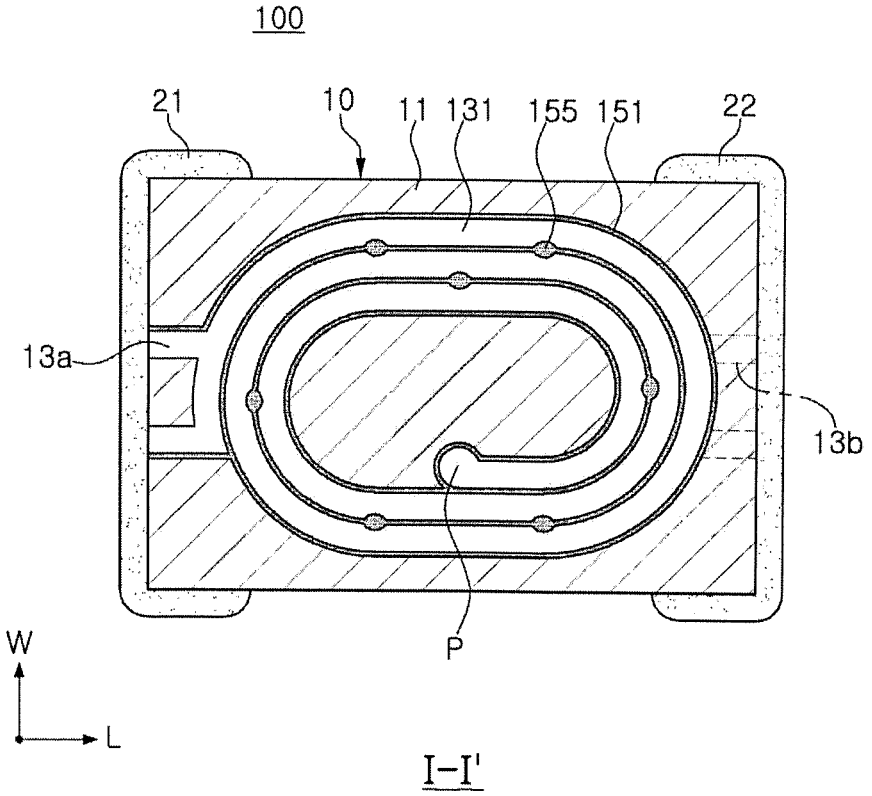
FIG. 2 illustrates a cross-sectional view taken along line I-I' of the coil component of FIG. 1.
Figure 3:
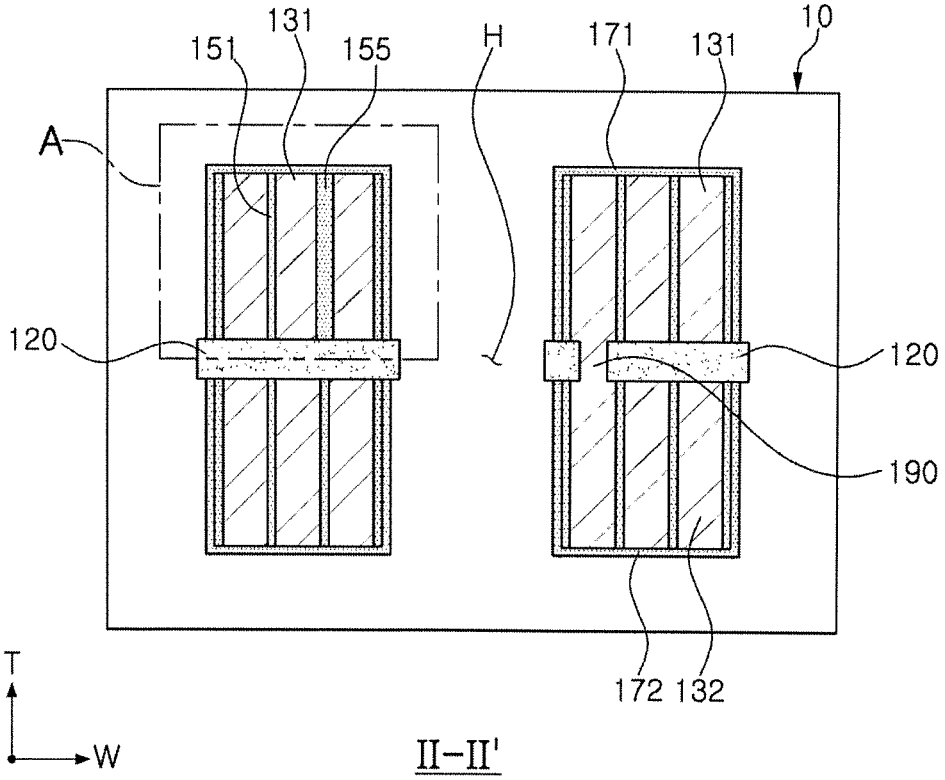
FIG. 3 illustrates a cross-sectional view taken along line II-II' of the coil component of FIG. 1.

FIG. 1 is a schematic perspective view illustrating a coil component according to an exemplary embodiment in the present disclosure, FIG. 2 illustrates a cross-sectional view taken along line I-I' of the coil component of FIG. 1, and FIG. 3 illustrates a cross-sectional view taken along line II-II' of the coil component of FIG. 1.

Referring to FIGS. 1 through 3, a coil component 100 according to an exemplary embodiment in the present disclosure may include a body 10, a coil part 13, and first and second external electrodes 21 and 22. In addition, the coil part 13 may include a coil pattern 130, pattern walls 151, and a support member 120 supporting the coil pattern 130.

The body 10 may foam an overall outer shape of the coil component, and may include an upper surface and a lower surface opposing each other in a thickness direction (T), a first end surface and a second end surface opposing each other in a length direction (L), and a first side surface and a second side surface opposing each other in a width direction (W) to thus have substantially a hexahedral shape, but is not limited thereto.

The first and second external electrodes 21 and 22 may be disposed on outer surfaces of the body 10. The first and second external electrodes 21 and 22 are represented in a "C" shape in a cross-section cut along a length-width plane or a length-thickness plane. The first and second external electrodes 21 and 22 may be electrically connected to the coil part 13 embedded in the body 10, and a shape of each of the first and second external electrodes 21 and 22 is not limited to a "C" shape. In addition, the first and second external electrodes 21 and 22 may be formed of a conductive material. Specifically, the first external electrode 21 may be connected to a first leading part 13*a* of one end portion of the coil part 13, and the second external electrode 22 may be connected to a second leading part 13*b* of the other end portion of the coil part 13. Therefore, the first and second external electrodes 21 and 22 may electrically connect both ends of the coil part 13 to an external electrical component (e.g., a pad of a substrate).

The body 10 may include a magnetic material 11, and may be formed of, for example, a ferrite or a metal based soft magnetic material. The ferrite may include a ferrite known in the art, such as an Mn—Zn based ferrite, an Ni—Zn based ferrite, an Ni—Zn—Cu based ferrite, an Mn—Mg based ferrite, a Ba based ferrite, an Li based ferrite, or the like. In addition, the metal based soft magnetic material may be an alloy including one or more selected from the group consisting of iron (Fe), silicon (Si), chromium (Cr), aluminum (Al), and nickel (Ni). For example, the metal based soft magnetic material may include Fe—Si—B—Cr based amorphous metal particles, but is not limited thereto. The metal based soft magnetic material may have a particle diameter of 0.1 μm or more and 20 μm or less, and may be included in a polymer such as an epoxy resin, polyimide, or the like, in a form in which it is dispersed on the polymer.

The coil part 13 may be encapsulated to the body 10 by the magnetic material 11. In addition, the coil part 13 may include a support member 120 and a coil pattern 130.

As illustrated in FIGS. 1 and 3, the coil pattern 130 may include first and second coil patterns 131 and 132 disposed on opposite surfaces of the support member 120 opposing each other. That is, the first coil pattern 131 may be formed on one surface of the support member 120, and the second coil pattern 132 may be formed on the other surface of the support member 120 opposing one surface of the support member 120.

The support member 120 may serve to support the coil pattern 130 and may also serve to easily form an internal coil. The support member 120 may be suitably used as long as it has insulating properties and a thin film shape. For example, an insulating film such as a copper clad laminate (CCL) substrate or an Ajinomoto Build-up Film (ABF) may be utilized. A thickness of the support member 120 may be thin in order to meet a trend of miniaturized electronic components, but since the thickness is required to such an extent that the coil pattern 130 may be properly supported, the support member 120 may have a thickness of, for example, about 60 μm. In addition, a through-hole H may be formed in the center of the support member 120, and the through-hole H is filled with the magnetic material 11, such that overall magnetic permeability of the coil component 100 may be improved. A via hole 190 may be positioned at a position spaced apart from the through-hole H of the support member 120 by a predetermined interval. Since the inside of the via hole 190 is filled with a conductive material, the first coil pattern 131 and the second coil pattern 132 disposed on an upper surface and a lower surface of the support member 120 may be physically and electrically connected to each other via a via portion P.

Hereinafter, for convenience of explanation, the first coil pattern 131 will be described as a reference, and the contents thereof may be applied to the second coil pattern 132 as it is.

The first coil pattern 131 may form a plurality of windings. For example, the first coil pattern 131 may have a form wound in a spiral shape, and the number of windings may be appropriately selected depending on a design. The first coil pattern 131 may be formed by an electroplating process.

The first coil pattern 131 may be formed of a metal having excellent electrical conductivity. For example, the first coil pattern 131 may be formed of silver (Ag), palladium (Pd), aluminum (Al), nickel (Ni), titanium (Ti), gold (Au), copper (Cu), platinum (Pt), or alloys thereof, but is not necessarily limited thereto.

In addition, the coil part 13 may further include the pattern walls 151. In addition, the coil pattern 130 may extend between the pattern walls 151 on the support member 120. Direct current (DC) resistance Rdc characteristics, which are one of main characteristics of the coil component, for example, an inductor, may be reduced as a cross-sectional area of the coil is increased. In addition, an inductance may be increased as an area of a magnetic region in the body through which a magnetic flux passes is increased. Therefore, in order to decrease the DC resistance Rdc and increase the inductance, the cross-sectional area of the coil needs to be increased and the area of the magnetic region needs to be increased. As a method of increasing the cross-sectional area of the coil part, there are a method of increasing widths of the coil patterns and a method of increasing thicknesses of the coil patterns. However, in a case of simply increasing the width of the coil pattern, there is a risk that a short circuit between the coil patterns will occur. In addition, a limitation is generated in the number of windings of coil patterns that may be implemented, which leads to a decrease in area occupied by the magnetic region, such that efficiency is decreased and a limitation is also generated in implementing a high inductance product. On the other hand, in a case of implementing conductor patterns having a high aspect ratio by increasing thicknesses of conductor patterns without increasing widths of the conductor patterns, the above-mentioned problems may be solved. According to the present disclosure, since the pattern walls 151 are utilized as plating growth guides to form the coil patterns, shapes of the coil patterns may be easily adjusted.

The pattern walls 151 may have a fine width (e.g., 12 μm or less) to maximally secure the widths of the coil patterns. In addition, the pattern walls 151 may have a height corresponding to an intended aspect ratio of the coil pattern to serve as the plating growth guides of the coil pattern. However, the pattern walls 151 may be tilted or collapsed by unintended effects (e.g., Laplace pressure) before and after the plating process. According to the present disclosure, the pattern walls 151 may include support portions 155. The support portions 155 may have a width greater than an average width of the pattern walls 151. That is, the support portions 155 correspond to some regions of the pattern walls 151 in which the pattern walls 151 have a wider width than other regions of the pattern walls 151. Since the support portions 155 have the wider width and are bonded to the support member 120 with a wider area, the support portions 155 may support the shape of the pattern walls 151 so that the pattern walls 151 are not tilted or collapsed.

Such support portions 155 may be disposed on a plurality of regions of the pattern walls 151. In addition, the plurality of support portion 155 may be symmetrically disposed around a winding axis of the coil pattern 130. Alternatively, in order to solve the problem that the pattern walls 151 do not maintain the shape thereof, the support portions 155 may be selectively disposed at positions for efficiently reinforcing the pattern walls 151.

In addition, since the problem that the pattern walls 151 are tilted does not occur in a portion of the pattern walls 151 disposed at the outermost portion of the coil part, the support portion 155 may not be formed on a portion of the pattern walls 151 forming the outermost portion of the coil part.

Meanwhile, the upper surface of the first coil pattern 131 may be covered with a first insulating layer 171. Alternatively, as illustrated in FIG. 3, the first insulating layer 171 may entirely coat the first coil pattern 131. Such a first insulating layer 171 may have a function of insulating the first coil pattern 131 so that the first coil pattern 131 is not in contact with the magnetic material 11 filled in the body 10. In addition, a second insulating layer 172 coating the second coil pattern 132 may have the same function as that of the first insulating layer 171.

Figure 4:
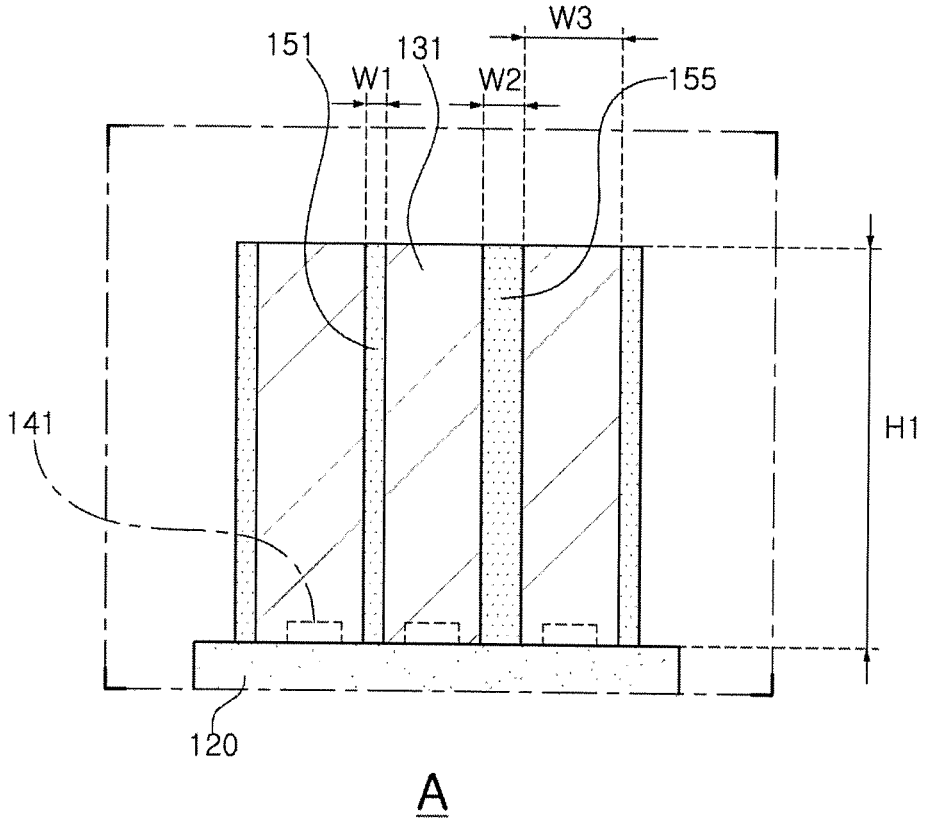
FIG. 4 illustrates a schematic enlarged view of a region A of the coil component of FIG. 3.

FIG. 4 illustrates a schematic enlarged view of a region A of the coil component of FIG. 3. For convenience of explanation, the first insulating layer 171 is not illustrated.

In order to increase the cross-sectional area within a limited space, the first coil pattern 131 may have a shape in which a ratio of a height H1 to a width W3, that is, an aspect ratio is large. For example, a high aspect ratio that the coil pattern may have may be about 3 to 20.

The first coil pattern 131 may be formed by plating growth after the pattern walls 151 and 155 are formed. To this end, before forming the pattern walls 151 and 155, a plating seed 141 may be disposed on the support member 120. The plating seed 141 may be formed by an electroless plating process. After the pattern walls 151 and 155 having a partition shape are formed, the first coil pattern 131 may be formed using the plating seed 141 as a seed of a plating process. In order to have a high aspect ratio, the first coil pattern 131 may be formed by several plating processes, and in this case, the first coil pattern 131 may have a multilayer structure. The pattern walls 151 and 155 may be formed of a photosensitive resin in which one photo acid generator and several epoxy-based resin are combined, and one or more epoxies may be used.

In such a plating process, the support portions 155 may serve to support the pattern walls 151 to prevent the pattern walls 151 from being tilted. In addition, a width W2 of the support portion 155 may be greater than a width W1 of the pattern wall 151 on which the support portion 155 is not disposed. For example, the maximum width of the support portion 155 may be 1.4 times greater than widths of other regions of the pattern wall 151.

Figure 5:
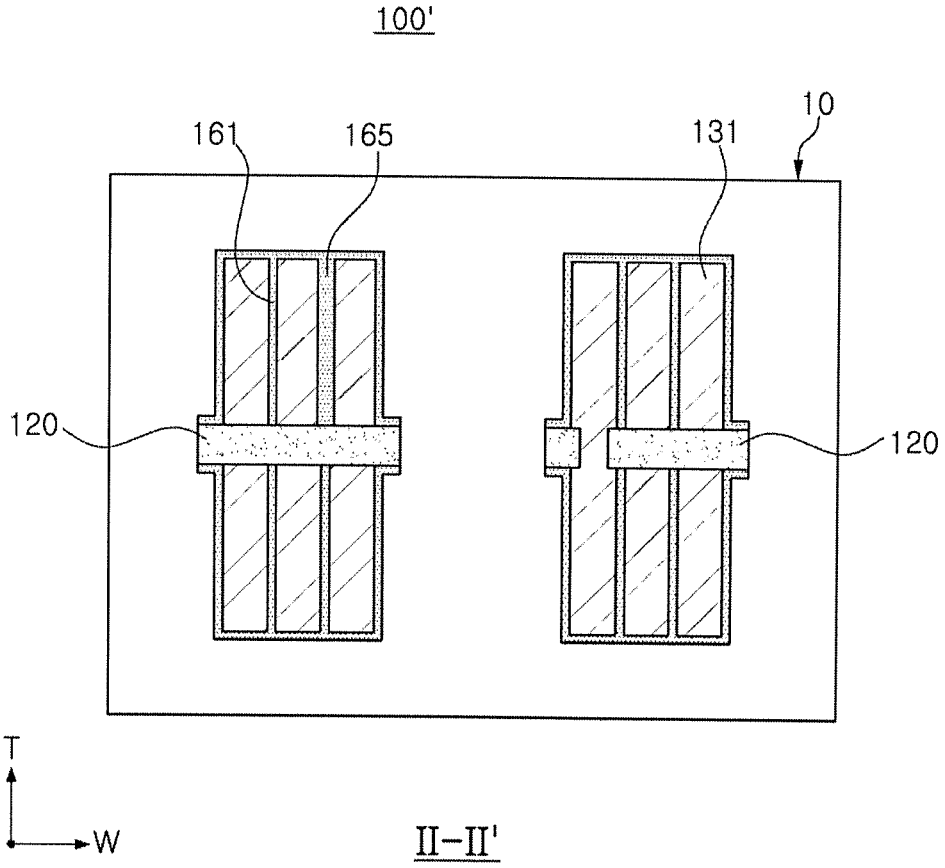
FIG. 5 illustrates another example of a cross-sectional view taken along line II-II' of the coil component of FIG. 1.

FIG. 5 illustrates another example of a cross-sectional view taken along line II-II' of the coil component of FIG. 1.

As compared to FIG. 3, pattern walls 161 of a coil component 100' illustrated in FIG. 5 may be formed of an insulating material filled after a photosensitive resin is removed. Specifically, after the first coil patterns 131 are formed and the photosensitive resin formed between the first coil patterns 131 is removed by a delamination liquid, the insulating material may be filled in spaces from which the photosensitive region is removed. In addition, the first coil patterns 131 may be covered with the insulating material. Accordingly, the pattern walls 161 and the insulating material covering the first coil patterns 131 may be formed integrally. The support portions 165 may also be formed of the insulating material. In this case, the insulating material may also serve as the insulating layer 171 (FIG. 3) to prevent a contact with the magnetic material filled in the body 10.

According the present disclosure, since the pattern walls are used as the plating growth guides and the pattern walls include the support portions, the coil pattern having a high aspect ratio may be implemented, and a short-circuit failure and an electrical over stress (EOS) failure due to the pattern walls not maintaining the shape may be eliminated.

In the present disclosure, terms "first", "second", and the like, are used to distinguish one component from another component, and do not limit a sequence, importance, and the like, of the corresponding components. In some cases, a first component may be named a second component and a second component may also be similarly named a first component, without departing from the scope of the present disclosure.

As set forth above, according to an exemplary embodiment in the present disclosure, since the pattern walls including the support portions are employed between the coil patterns, the risk of the short-circuit failure and an electrical over stress (EOS) failure that may occur in the coil component may be eliminated.

Various advantages and effects of the present disclosure are not limited to the description above, and may be more readily understood in the description of exemplary embodiments in the present disclosure.

While exemplary embodiments have been shown and described above, it will be apparent to those skilled in the art that modifications and variations could be made without departing from the scope of the present invention as defined by the appended claims.

What is claimed is:

1. A coil component comprising:

a body in which a coil part is embedded, wherein the coil part includes:

a support member;

pattern walls formed on the support member in a winding direction; and coil patterns extending between the pattern walls on the support member, the pattern walls include support portions having a width greater than an average width of the pattern walls, at least one of the support portions is arranged between adjacent coil patterns of the coil patterns, the at least one of the support portions is arranged between adjacent portions of the pattern walls, arranged between the adjacent coil patterns, in the winding direction, and (1) the at least one of the support portions includes at least three support portions arranged in one turn of the coil part, or (2) the at least one of the support portions includes at least one support portion arranged in a linear portion of the coil part.

2. The coil component of claim 1, wherein the support portions are disposed on a plurality of regions of the pattern walls.

3. The coil component of claim 2, wherein the plurality of support portions are symmetrically disposed around a winding axis of the coil patterns.

4. The coil component of claim 1, wherein an outermost portion of the pattern walls has substantially a same width.

5. The coil component of claim 1, wherein the coil patterns includes seed patterns in contact with the support member and plating layers covering the seed patterns.

6. The coil component of claim 1, wherein the pattern walls are formed of a photosensitive resin.

7. The coil component of claim 1, wherein an insulating material forming the pattern walls extends to cover upper surfaces of the coil patterns.

8. The coil component of claim 1, wherein the support member includes a through-hole in the center of the coil part, and the through-hole is filled with a magnetic material.

9. The coil component of claim 1, wherein the pattern walls and the coil patterns are disposed on both surfaces of the support member opposing each other.

10. The coil component of claim 9, wherein the coil part includes a through via connecting the coil patterns disposed on both surfaces to each other.

11. The coil component of claim 1, wherein the maximum width of the support portion is 1.4 times or more as compared to the width of other regions of the pattern wall.

12. The coil component of claim 1, wherein the coil part further includes an insulating layer covering upper surfaces of the coil patterns.

* * * * *